US007579710B2

(12) United States Patent
Hisamoto et al.

(10) Patent No.: US 7,579,710 B2
(45) Date of Patent: Aug. 25, 2009

(54) STARTER CONTROL DEVICE AND STARTER

(75) Inventors: Motoi Hisamoto, Tokyo (JP); Syozo Kanzaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 454 days.

(21) Appl. No.: 10/322,878

(22) Filed: Dec. 19, 2002

(65) Prior Publication Data

US 2003/0214766 A1 Nov. 20, 2003

(30) Foreign Application Priority Data

May 14, 2002 (JP) ..... P2002-138405

(51) Int. Cl.
*F02P 9/00* (2006.01)
*F02N 11/00* (2006.01)

(52) U.S. Cl. ..... 307/10.6; 123/179.3

(58) Field of Classification Search ..... 335/126, 335/131, 128; 290/37 A, 37 R, 38, 38 R; 307/10.6

See application file for complete search history.

(56) References Cited

U.S. PATENT DOCUMENTS 4,490,620 A * 12/1984 Hansen ..... 290/38 R
5,065,039 A * 11/1991 Isozumi et al. ..... 290/48
5,939,960 A * 8/1999 Godel et al. ..... 335/126
6,028,381 A 2/2000 Yumiyama et al.
6,049,263 A * 4/2000 Vilou ..... 335/126
6,116,201 A 9/2000 LaBelle
6,148,781 A * 11/2000 Boegner et al. ..... 123/179.3
2002/0006358 A1 * 1/2002 Sugiyama ..... 422/98

FOREIGN PATENT DOCUMENTS

| | | | |
|---|---|---|---|
| DE | 19532484 | A | 8/1996 |
| DE | 19813601 | A | 10/1998 |
| DE | 10046987 | A | 4/2002 |
| JP | 62-007973 | A | 1/1987 |
| JP | 5-90983 | | 12/1993 |
| JP | 7-8811 | | 2/1995 |
| JP | 9-105372 | | 4/1997 |
| JP | 10-106420 | | 4/1998 |
| JP | 2000-87831 | | 3/2000 |

* cited by examiner

*Primary Examiner*—Fritz M Fleming
*Assistant Examiner*—Dru M Parries
(74) *Attorney, Agent, or Firm*—Sughrue Mion, PLLC

(57) ABSTRACT

A starter control device includes an auxiliary switch for controlling an operation of a starter main switch, the auxiliary switch having a cap made from an insulating member. The starter control device also includes a control circuit part disposed on the cap, a terminal disposed on the cap, and a connection metal attachment for connecting the control circuit part and the terminal.

15 Claims, 7 Drawing Sheets

STARTER CONTROL DEVICE AND STARTER

BACKGROUND OF THE INVENTION

1. Field of the Invention

The present invention relates to a starter control device for controlling a starter to start an engine and a starter having the control device, particularly to a structure in which a control circuit part is provided on a cap of an auxiliary switch.

2. Description of the Related Art

A conventional device of this type is disclosed in Japanese Patent Laid-Open No. 2000-87831, for example. In a starter protector device thus disclosed, a protector circuit is disposed in a space defined by legs of a mounting bracket of an auxiliary switch. The protector circuit and a terminal provided on a cap of the auxiliary switch are connected to each other by a lead wire.

In the starter protector device thus structured, since the protector circuit and the terminal provided on the cap of the auxiliary switch are connected to each other by the lead wire, additional work is required to remove the insulating cover from the lead wire and additional work is required to apply preliminary soldering to a conductive part of the lead wire. Also, performance in regard to vibration proofing is degraded. Further, to integrally form the auxiliary switch and the protector circuit, it is necessary to greatly alter the structure.

SUMMARY OF THE INVENTION

Accordingly, an object of the present invention is to provide a starter control device in which an electrical connection between a control circuit part and a terminal provided on a cap of an auxiliary switch is easy, a vibration proof performance is excellent, and an integration of the auxiliary switch with the control circuit part is easy, and to provide a starter which is integrated with the starter control device and is easy in electrical connection and mounting.

According to an aspect of the invention, there is provided a starter control device including: an auxiliary switch for controlling an operation of a starter main switch, the auxiliary switch having a cap made from an insulating member; a control circuit part disposed on the cap; a terminal disposed on the cap; and a connection metal attachment for electrically connecting the control circuit part and the terminal.

According to another aspect of the invention, there is provided a starter including: a starter main switch; and a starter control device, wherein the starter control device comprises: an auxiliary switch for controlling an operation of the starter main switch, the auxiliary switch having a cap made from an insulating member; a control circuit part disposed on the cap; a terminal disposed on the cap; and a connection metal attachment for electrically connecting the control circuit part and the terminal.

With such a structure, the present invention provides the starter control device and the starter improved in that the electrical connection is easy, the device size is small, the integration of the auxiliary switch with the control circuit part is easy, and the cost to manufacture is low.

DETAILED DESCRIPTION OF THE PREFFERED EMBODIMENTS

First Embodiment

Figure 1:
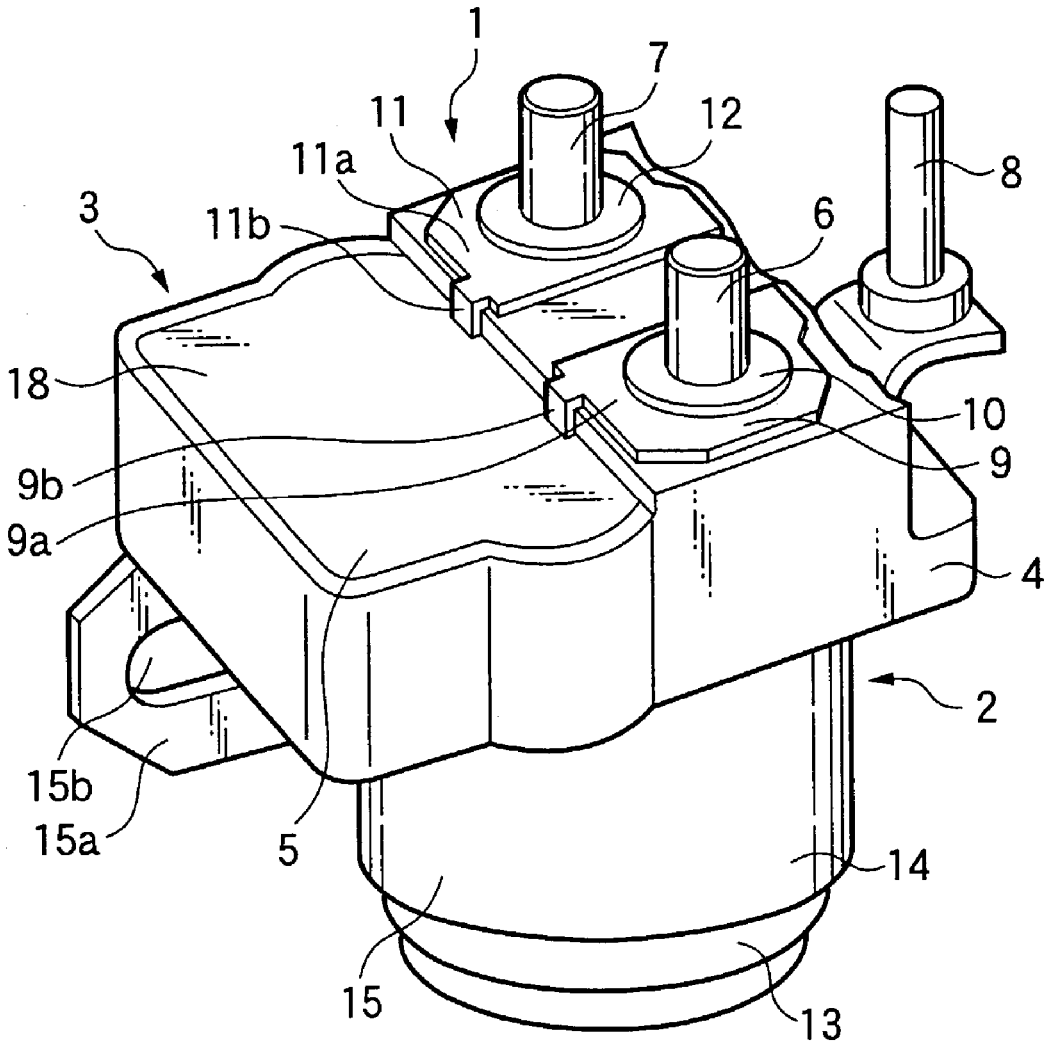
FIG. 1 is a perspective view showing a starter control device which is a first embodiment of the present invention.
Figure 2:
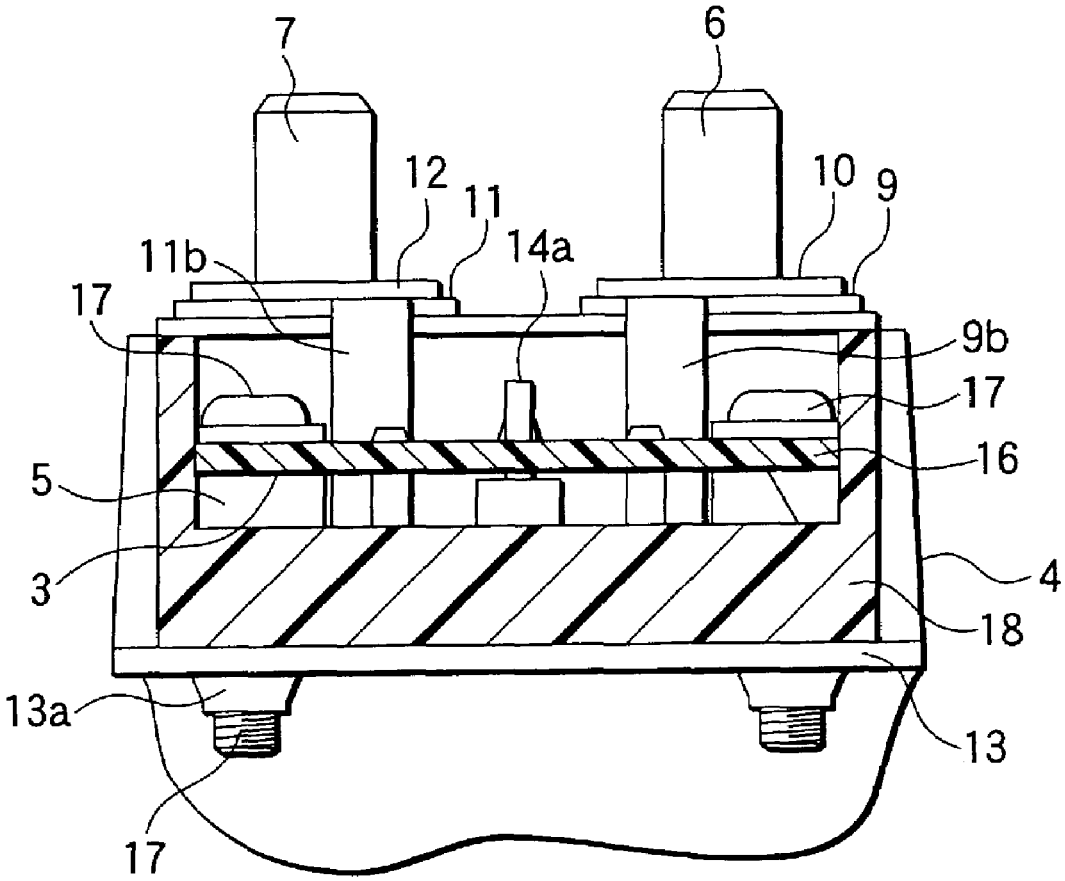
FIG. 2 is a cross sectional view showing a main portion of the starter control device of the first embodiment.
Figure 3:
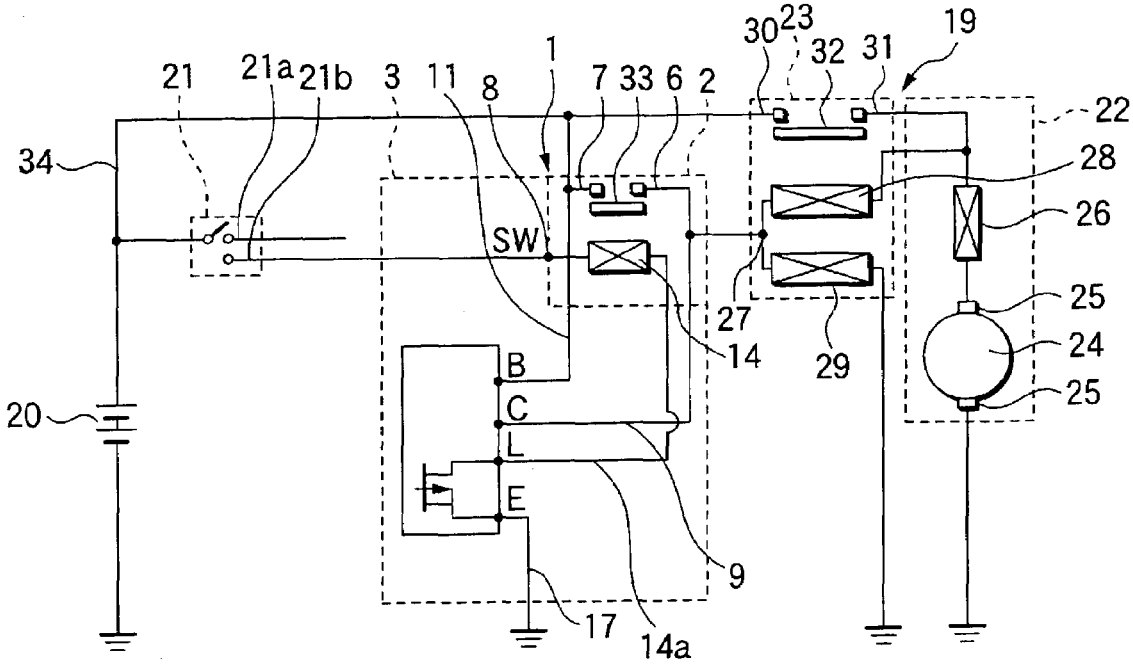
FIG. 3 is an electric wiring diagram in the first embodiment.
Figure 4:
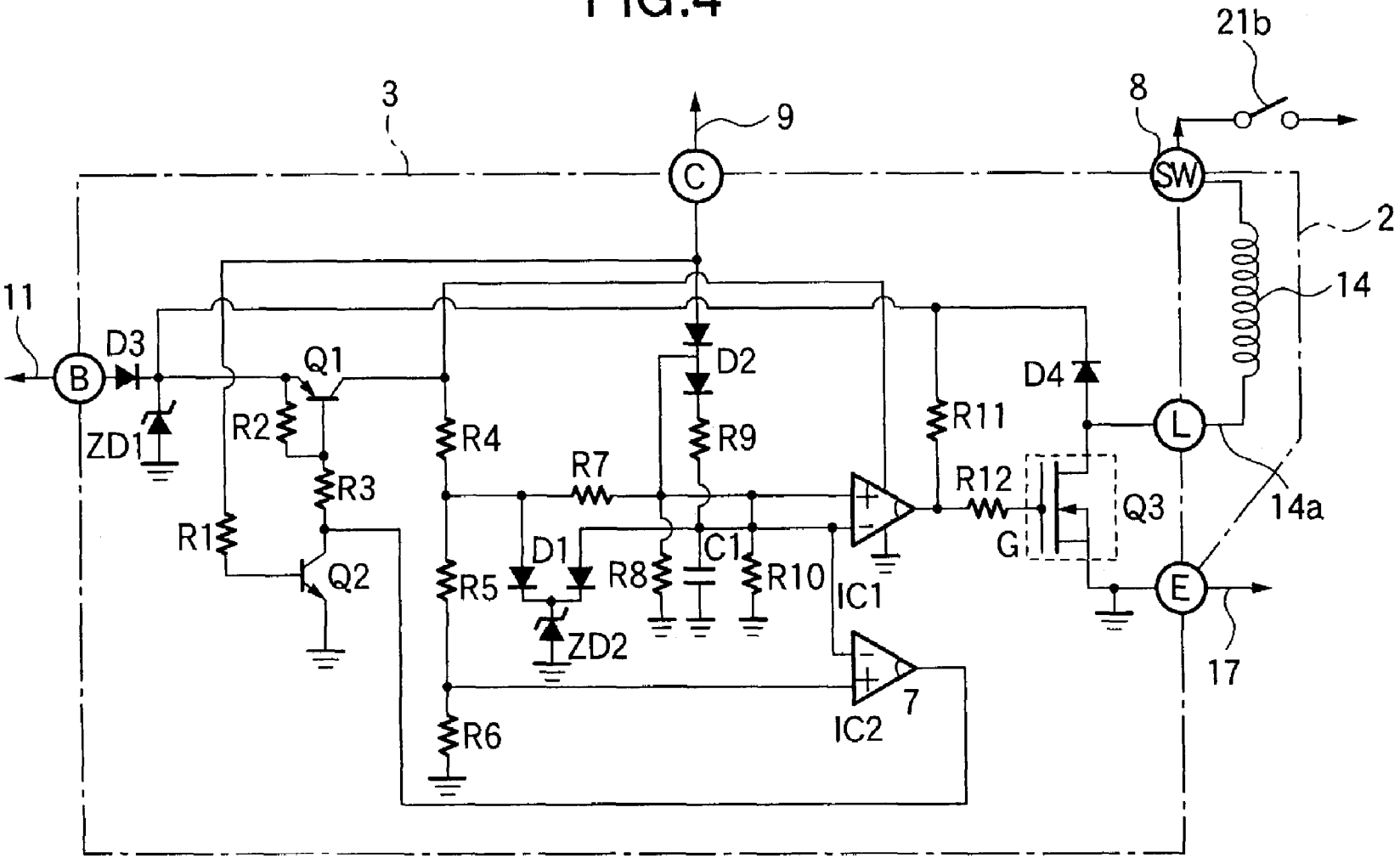
FIG. 4 is a circuit diagram showing a control circuit part in the first embodiment.
Figure 5A:
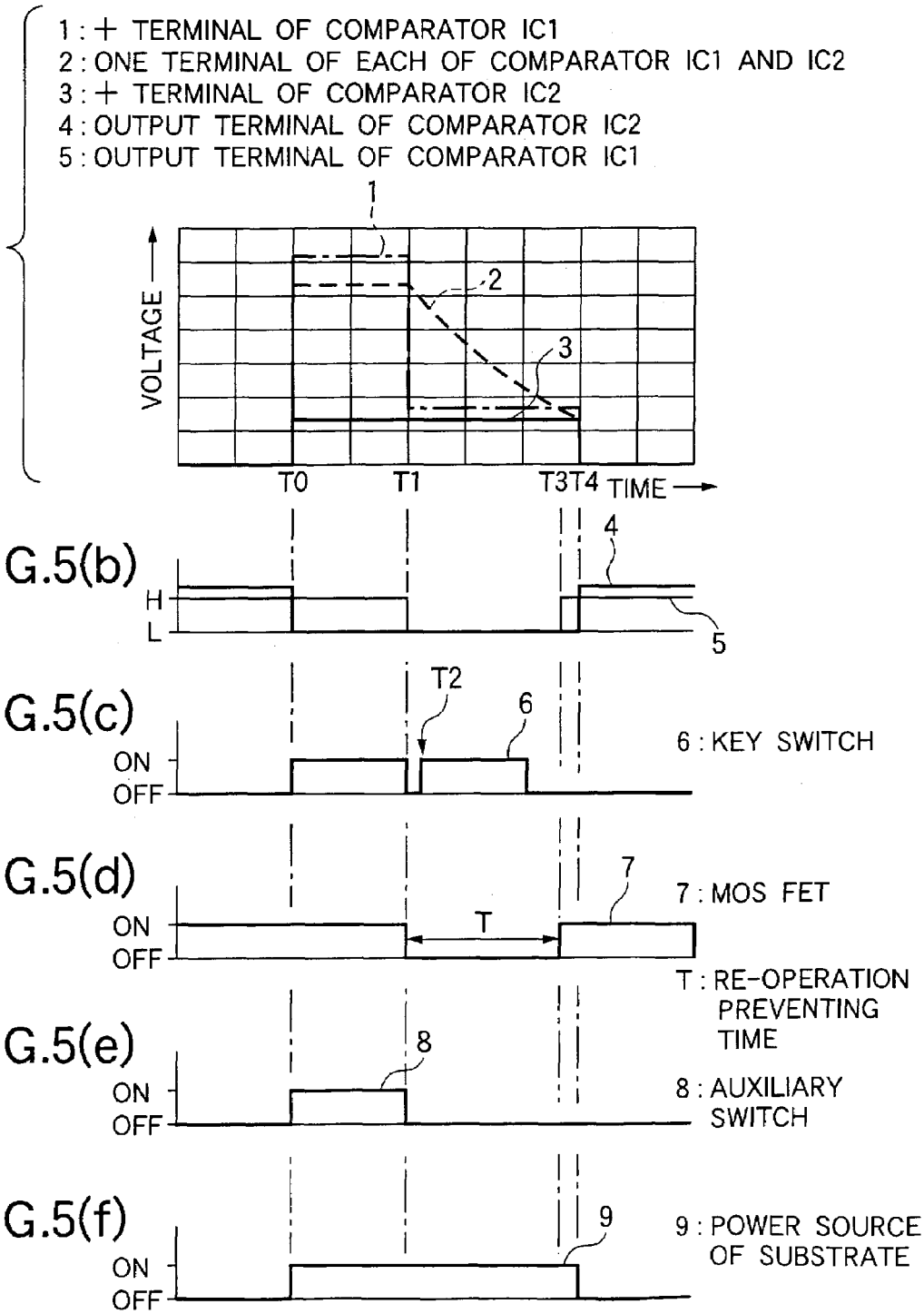
FIGS. 5(*a*) to 5(*f*) are timing charts showing an operation of the first embodiment.

A first embodiment of the present invention will be described with reference to the accompanying drawings. FIG. 1 is a perspective view showing a starter control device which is a first embodiment of the present invention. FIG. 2 is a cross sectional view showing a main portion of the starter control device of the first embodiment. FIG. 3 is an electric wiring diagram in the first embodiment. FIG. 4 is a circuit diagram showing a control circuit part in the first embodiment. FIGS. 5(*a*) to 5(*f*) are timing charts showing an operation of the first embodiment. Throughout those figures, like or equivalent portions are designated by like reference numerals, for simplicity. In FIG. 1, reference numeral 1 is a starter control device, which is integrally formed with an auxiliary switch 2 and a control circuit part 3. A cap 4, made of an insulating material such as a phenolic resin is integrally formed with a housing 5 that contains the control circuit part 3. A cap of a normal auxiliary switch 2 not having the control circuit part 3 is modified to form the housing 5. The cap 4 is provided with a C terminal 6, a B terminal 7 and a SW terminal 8, all of which are made of copper or the like. The C terminal 6 and a seat 9*a* of a connection metal attachment 9, which is made of a conductive material such as a brass and formed by press bending, are mechanically and firmly fixed and electrically connected to the cap 4 by use of a washer 10. A connection part 9*b* as one end of the connection metal attachment 9 is bent toward the housing 5, which contains the control circuit part 3, and connected to the control circuit part 3. Similarly, the B terminal 7 and a seat 11*a* of a connection metal attachment 11 are mechanically and firmly fixed and electrically connected to the cap 4 by use of a washer 12. A connection part 11*b* as one end of the connection metal attachment 11 is bent toward the housing 5, which contains the control circuit part 3, and connected to the control circuit part 3.

The auxiliary switch 2 includes a coil 14, which is housed in a case 13 formed of a conductive member such as an iron plate. One end of the coil 14 is connected to the SW terminal 8 provided on the cap 4. The C terminal 6 and the B terminal 7 are electrically connected to and disconnected from each other depending on current fed to the coil 14. A mounting bracket 15 formed of a conductive member such as an iron plate is fastened to the cylindrical outer peripheral surface of the case 13 by welding or the like. The mounting bracket 15 includes a leg part 15*a* having a mounting hole 15*b*.

FIG. 2 is a cross sectional view showing a main portion of FIG. 1. As seen in FIG. 2, the control circuit part 3 is contained in the housing 5 that is integrally formed with the cap 4. The C terminal 6 is electrically connected by soldering or the like to a substrate 16 of the control circuit part 3 via the connection part 9*b* of the connection metal attachment 9. Similarly, the B terminal 7 is electrically connected to the substrate 16 of the control circuit part 3 via the connection part 11*b* of the connection metal attachment 11. The other terminal 14*a* of the coil 14 is connected to the substrate 16 by soldering or the like. The substrate 16 is fastened to a screw part 13*a* provided on the case 13 together with the cap 4 by means of screws 17 made of a conductive material such as an iron, and firmly fixed to the case 13. In this way, the control circuit part 3 is grounded to the case 13 and the mounting bracket 15 through the substrate 16 and the screws 17. After the installing and connecting work of the control circuit part 3 is complete, the housing 5 is filled with a resin 18 such as an epoxy resin. The resin 18 is solidified, whereby the control circuit part 3 is secured and sealed.

As shown in FIG. 3, the starter control device 1, starter 19, battery 20 and key switch 21 are electrically wired. The starter 19 includes a motor unit 22 and a main switch 23. The motor unit 22 includes an armature 24, a brush 25 for feeding a current to the armature 24, and a field coil 26 generating a magnetic pole. The main switch 23 includes a P coil 28 and an H coil 29 which are connected to an S terminal 27 and controls an operation of the starter 19, a battery terminal 30 constituting an electric contact, a motor terminal 31, and a movable contact 32. The starter control device 1 includes the auxiliary switch 2 and the control circuit part 3. The auxiliary switch 2 includes the C terminal 6, B terminal 7 and a movable contact 33, which constitute electric contacts, and the coil 14 for controlling the opening and/or closing of those electric contacts.

A plus side of the battery 20 is connected to the battery terminal 30 of the starter 19 through a battery cable 34, and a minus side of the battery 20 is earthed. The plus side of the battery 20 is connected to the SW terminal 8 of the starter control device 1 by way of a starter terminal 21*b* of a key switch 21. Reference numeral 21*a* designates an ON terminal 21*a* of the key switch 21 and is used during engine running. The starter terminal 21*b* is made contact at the time of engine starting operation. The plus side of the battery 20 is connected to the B terminal 7 of the starter control device 1. The C terminal 6 is connected to the S terminal 27 of the main switch 23. The internal connection of the starter control device 1 is as described above.

In FIG. 4 showing a circuit diagram of the control circuit part 3, Q1 and Q2 are transistors; Q3 is an FET; IC1 and IC2 are comparators; D1 to D4 are diodes; ZD1 and ZD2 are Zener diodes; R1 to R12 are resistors; and C1 is a capacitor. Those circuit components are connected as shown in FIG. 4. Voltage is constantly applied from the battery 20 to a point B in FIG. 4, by way of the B terminal 7 and the connection metal attachment 11. Voltage is applied from the battery 20 also to the gate G of the FET Q3, and the FET Q3 is in an ON state. The minus terminal of the comparator IC1 and the minus terminal of the comparator IC2 are interconnected. When the C terminal 6 is in an On state, a voltage defined by the Zener diode ZD2 and diode D1 is applied to the comparators. Specifically, when the C terminal 6 is in an ON state, voltage is applied to the plus terminal of the comparator IC1, and the voltage applied is higher than that applied to the minus terminal of the comparator IC1 by a voltage across the diode D2. When the C terminal 6 is in a off state, a voltage which is produced by dividing a voltage defined by the Zener diode ZD2 and the diode D1 by the resistors R7 and R8 is applied to the comparators. A voltage which is produced by dividing the voltage determined by the Zener diode ZD2 and the diode D1 by the resistors R5 and R6, is applied to the plus terminal of the comparator IC2. This voltage applied is lower than the voltage applied to the plus terminal of the comparator IC1.

Operation of the first embodiment thus structured will be described. To start the engine, the starter terminal 21*b* of the key switch 21 is closed. Since the FET Q3 is in an on state, a current flows from the battery 20 to the coil 14 by way of the starter terminal 21*b* and the SW terminal 8. The movable contact 33 is moved to close a circuit between the B terminal 7 to the C terminal 6. When the movable contact 33 is closed, voltage is applied from the battery 20 to the S terminal 27 of the main switch 23 by way of the C terminal 6. The P coil 28 and the H coil 29 are fed with a current, and the movable contact 32 is moved to close a circuit between the battery terminal 30 and the motor terminal 31. When the movable contact 32 is closed, a current flows from the battery 20 into the motor unit 22 by way of a route of the battery cable 34, battery terminal 30, movable contact 32, and motor terminal 31. The armature 24 is rotated through the electromagnetic action between the field coil 26 and the armature 24, and a rotational force causes the engine to start. When the engine starts, and the key switch 21 is returned from the starter terminal 21*b* to the ON terminal 21*a*, the current flowing to the coil 14 of the auxiliary switch 2 is shut off. The movable contact 33 is closed and the movable contact 32 is opened, so that the current flowing to the motor unit 22 is stopped, and here the engine starting operation is completed.

The operation of the control circuit part 3 will be described with reference to FIG. 4. As described above, the FET Q3 is in an on state. When the starter terminal 21*b* of the key switch 21 is closed, a current is fed from the battery 20 to the coil 14 by way of the SW terminal 8. The movable contact 33 is moved to close the circuit between the B terminal 7 and the C terminal 6, so that voltage of the battery 20 appears at the C terminal 6. The voltage is led from the C terminal 6 to a point C in FIG. 4 by way of the connection metal attachment 9. The current flows through the resistor R1 to reach and turn on the transistor Q2 and the transistor Q1, thereby generating the power source to the comparators IC1 and IC2 and the input voltage. The current also passes through the diode D2 and the resistor R9, and charges the capacitor C1. Since the voltage at the plus terminal of the comparator IC1 is higher than that at the minus terminal thereof, a logic state at the output of the comparator IC1 is H (high), and the on state of the FET Q3 continues. Since the voltage at the plus terminal of the comparator IC2 is lower than that at the minus terminal thereof, a logic state at the output of the comparator IC2 is L (low), and hence the on state of the transistor Q1 continues. This state continues till the starter terminal 21*b* of the key switch 21 is disconnected and the starter 19 drives the engine for its starting.

Next, description will be given about a case where the armature 24 of the starter 19 rotates to drive the engine for its starting, but the engine fails to start and the starting operation stops. The key switch 21 is returned from the starter terminal 21*b* to the ON terminal 21*a*, and immediately thereafter the key switch is set at the position of the starter terminal 21*b*. Since the key switch 21 is returned from the starter terminal 21*b* to the ON terminal 21*a*, the current to the coil 14 is interrupted, and the movable contact 33 is closed. Accordingly, voltage having appeared at the C terminal 6 disappears. When the voltage disappears at the C terminal 6, the capacitor C1 having been charged to the voltage determined by the Zener diode ZD2 and the diode D1 discharges at a time constant defined by the resistor 10 and the capacitor C1. With the discharging operation, the voltage at the minus terminals of the comparators IC1 and IC2 gradually decreases. Thus, a timer circuit is constituted, in which the capacitor C1 is discharged at the time constant defined by the resistor 10 and the capacitor C1.

The voltage produced by dividing the voltage as determined by the Zener diode ZD2 and the diode D1 by the resistors R7 and R8 is applied to the plus terminal of the comparator IC1. This voltage is lower than that at the minus terminal of the comparator IC1, and then a logic state at the output of the comparator IC1 is L, and the FET Q3 is turned off. Accordingly, the capacitor C1 discharges and gradually decreases to be lower than that at the plus terminal of the comparator IC1. The off state of the FET Q3 continues till the logic state at the output of the comparator IC1 is H. During this period, even if the key switch 21 is turned to the starter terminal 21*b*, no current is fed to the coil 14 since the FET Q3 is in the off state, and the starter 19 does not operate.

FIGS. 5(*a*) to 5(*f*) are timing charts showing those sequential operations. In FIG. 5(*a*), reference numeral 1 is voltage at the plus terminal of the comparator IC1; 2 is a voltage at the minus terminals of the comparators IC1 and IC2; and 3 is voltage at the plus terminal of the comparator IC2. Amplitude variations of those voltages with respect to time are illustrated in a model form. In FIG. 5(*b*), reference numeral 4 is a voltage amplitude variation at the output terminal of the comparator IC2. Reference numeral 5 designates a voltage amplitude variation at the output terminal of the comparator IC1. H indicates a logic high level at the output of the comparator, and L, a logic low level. 6 in FIG. 5(*c*) indicates on and off states at the starter terminal 21*b* of the key switch 21. 7 in FIG. 5(*d*) indicates on and off states of the FET Q3. 8 in FIG. 5(*e*) indicates on and off states at the movable contact 33 of the auxiliary switch 2. 9 in FIG. 5(*f*) indicates on and off states of the-power source of the substrate 16 of the control circuit part 3.

In FIGS. 5(*a*) to 5(*f*), at time T0, the starter terminal 21*b* of the key switch 21 is turned on (operated for starting) Before the time T0, the output terminal of the comparator IC2 is in a logic high level, and the output terminal of the comparator IC1 is in a logic high, and the FET Q3 is in an on state. During a period from time T0 to T1, the starter terminal 21*b* of the key switch 21 is turned on (operated for starting). The voltage at the plus terminal of the comparator IC1, voltage at the minus terminal of the comparators IC1 and IC2, and voltage at the plus terminal of the comparator IC2 vary as shown in FIG. 5(*a*). A logic state at the output terminal of the comparator IC2 varies from H to L. The output terminal of the comparator IC1 continues a high logic state. When the starter terminal 21*b* of the key switch 21 is turned off, the FET Q3 is turned off and the movable contact 33 of the auxiliary switch 2 is also turned off. Accordingly, the starter 19 operates in connection with the starting operation of the key switch 21. Accordingly, the power source of the substrate 16 of the control circuit part 3 continues the on state.

Then, during a time period from time T1 to T2, the starter terminal 21*b* is placed to an off state, and the starter terminal 21*b* is placed to an on state again at time T2. At this time, the voltage at the minus terminal of the comparator IC1 has been higher than that at the plus terminal of the comparator IC1. Therefore, the output terminal of the comparator IC1 is L in logic level, and the FET Q3 is in the off state, the movable contact 33 of the auxiliary switch 2 is also turned off, and the starter 19 does not operate. This time continues till the voltage at the minus terminal of the comparator IC1 becomes lower than that at the plus terminal of the comparator IC1, and at time T3, the FET Q3 is turned on. This time is time T in FIG. 5 and corresponds to a re-operation preventing time of the starter 19. Thereafter, at time T4, the voltage at the minus terminal of the comparator IC2 becomes lower than that at the plus terminal of the comparator IC2. As a result, the output terminal of the comparator IC2 is H in logic level, and the transistor Q1 is turned off. And the power source to the substrate 16 of the control circuit part 3 is turned off.

In a case where the armature 24 of the starter 19 rotates to drive the engine for its starting, but the engine fails to start by its trouble and the starting operation stops, the key switch 21 is returned from the starter terminal 21*b* to the ON terminal 21*a*, the armature 24 is rotating by inertia, and voltage is still generated by the remanence of the magnetic poles. The generated voltage is led to a point C in FIG. 4 by way of the S terminal 27, C terminal 6 and connection metal attachment 9. Even if the capacitor C1 is under discharging, the generated voltage causes the charging to the capacitor C1 so long as the generated voltage is higher than that across the capacitor C1. As a result, the circuit operates so as to elongate the re-operation preventing time T of the starter 19.

The first embodiment is thus structured. Accordingly, it is easy to form the housing 5 integral with the cap 4 of the auxiliary switch 2. The C terminal 6 and B terminal 7 of the auxiliary switch 2 are reliably connected to the control circuit part 3 by the connection metal attachment 9 and the connection metal attachment 11 by a short distance. With this technical feature, the invention brings about many advantages. The electrical connection is easy, the countermeasure to noise is ensured, the device size reduction is easy, excellent vibration proof is ensured, the physical integration of the auxiliary switch 2 with the control circuit part 3 is easy, and cost to manufacture is low. The starter control device 1 of the invention is easily applied to a starter system not having the control device. In this way, a starter 19 having such advantageous functions may easily be constructed. In this respect, the standardization of the starter 19 is ensured. Further, a resistance of the coil 14 of the auxiliary switch 2 is higher than that of the P coil 28 and the H coil 29 of the main switch 23. This enables a reduction in a required current and a reduction in size of the FET Q3 and the key switch 21.

An additional feature of the invention is that the C terminal 6 is connected to the control circuit part 3 by the connection metal attachment 9. With this feature, if the voltage at the C terminal 6 is detected, one can know that the starter terminal 21*b* of the key switch 21 is start-operated. Therefore, a wiring becomes unnecessary and the integration of the control circuit part with the auxiliary switch 2 is easy. A further feature is to detect the generated voltage of the starter 19. Therefore, there is prevented such an unwanted situation that the starter 19 operates during the inertia rotation of the armature 24, thereby damaging the starter 19 and parts of the engine side. Additionally, in the invention, the B terminal 7 is connected to the control circuit part 3 by the connection metal attachment 11. With this feature, there is no need of additional wiring for the power source of the control circuit part 3. The integration of it with the auxiliary switch 2 is easy. Furthermore, it is noted that the FET Q3 is in an on state. Therefore, the circuit response is quick. Even if something is wrong with the control circuit part 3, starting of the engine is possible.

Another advantageous feature of the invention is that the substrate 16 of the control circuit part 3 is earthed to the conductive case 13 by way of the conductive screws 17. This feature eliminates an additional wiring for earthing purpose. Further, the physical integration of it with the auxiliary switch 2 is easy. Current is fed to the coil 14 of the auxiliary switch 2 by way of the starter terminal 21*b* of the key switch 21. Accordingly, the integration of it with the auxiliary switch 2 is easy without additional wiring.

A further feature is that the timer circuit is contained in the control circuit part 3 to prohibit the re-operation of the starter 19. With this feature, there is prevented such an unwanted situation that during the inertia rotation of the engine and the armature 24, it re-bites in the engine to damage the engine and the starter 19. Yet another feature of the invention is that the on time of the power source of the control circuit part 3 is controlled. This feature brings about the following advantages. Even in a case where the power source to the control circuit part 3 is fed from the B terminal 7, the power source is automatically turned off after a predetermined time, and little power consumption is made, the life of the battery 20 is elongated, and advantageous contribution to noise reduction is effected.

Second Embodiment

Figure 6:
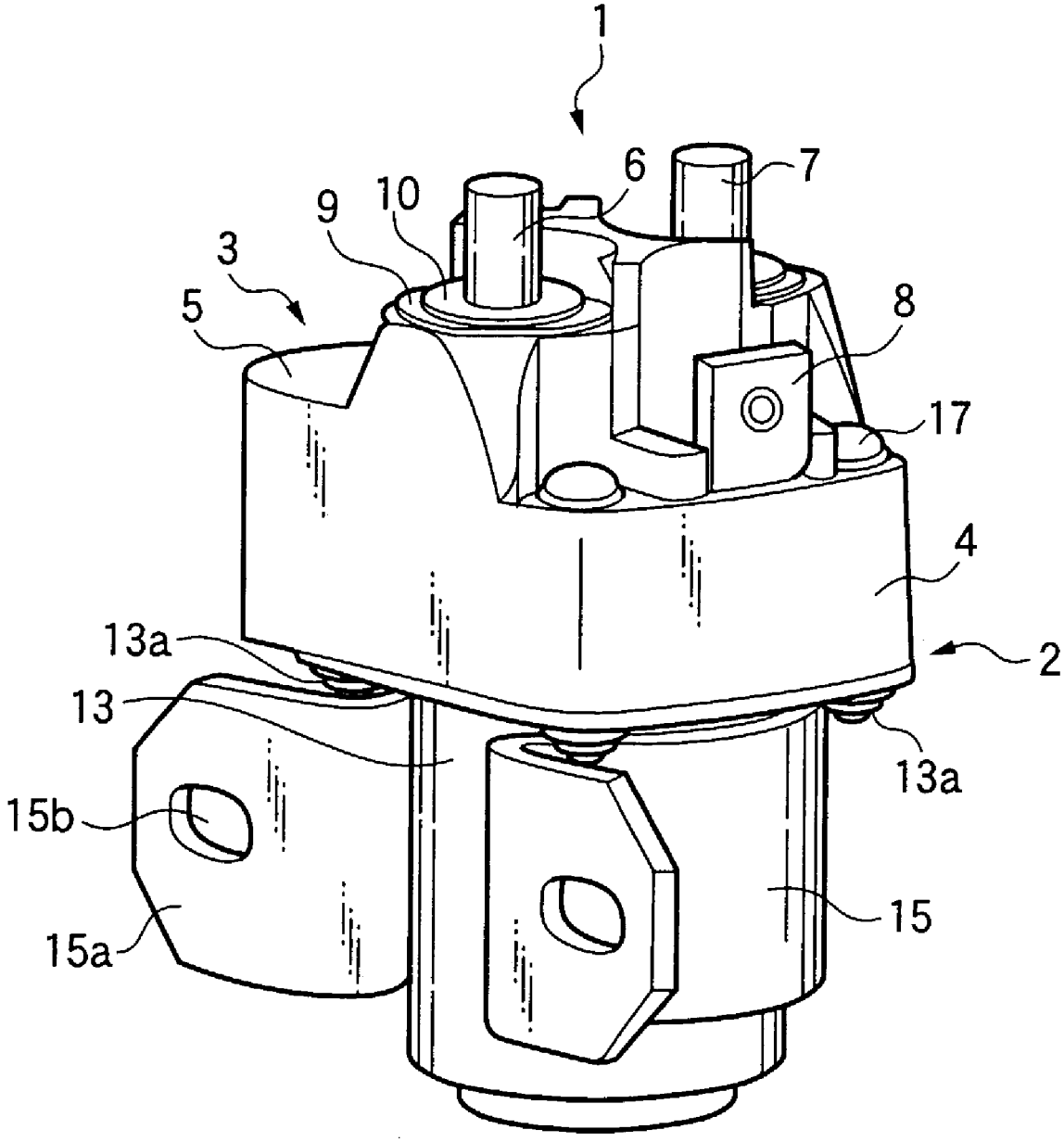
FIG. 6 is a perspective view showing a starter control device which is a second embodiment of the present invention.
Figure 7B:
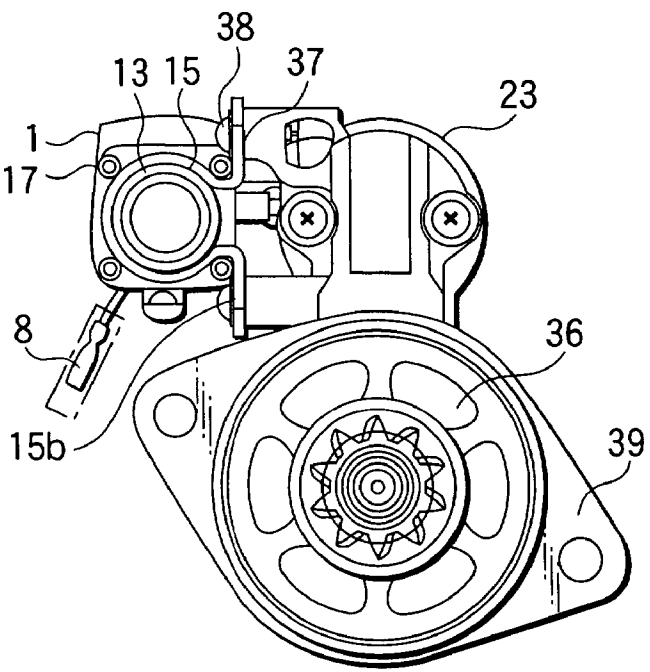
FIGS. 7(*a*) and 7(*b*) are a front view and a side view showing a starter having the starter control device of the second embodiment.
Figure 7A:
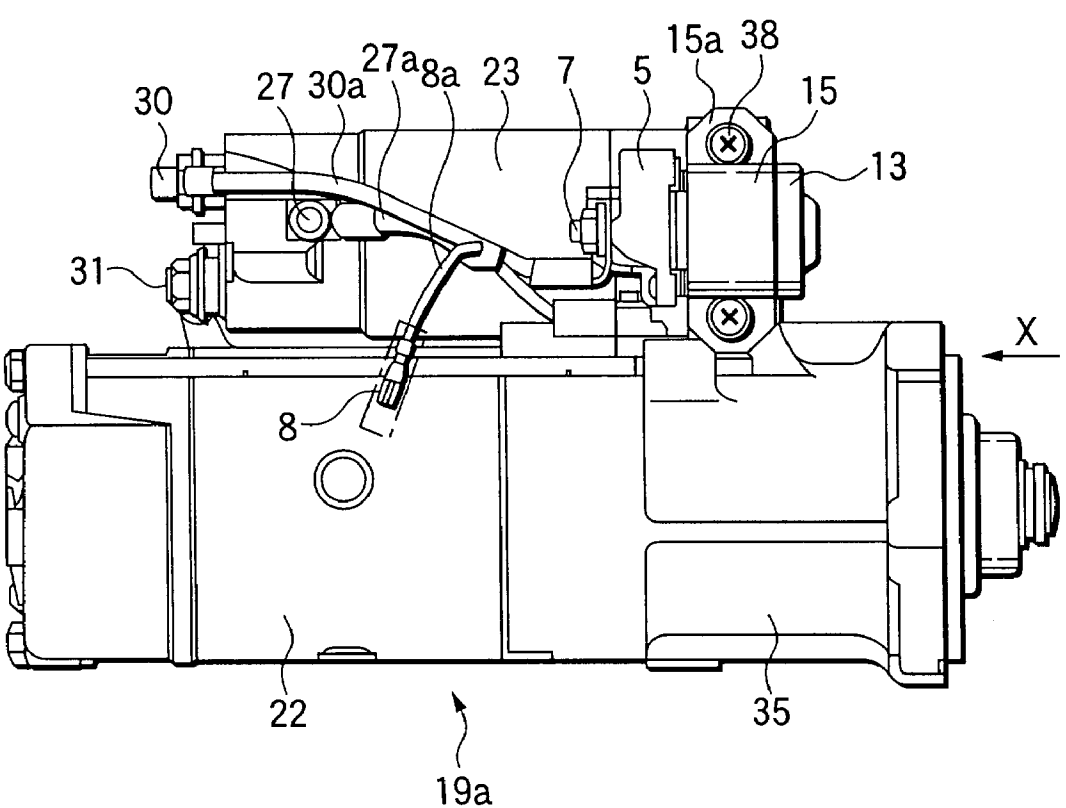

A second embodiment of the invention will be described. FIG. 6 is a perspective view showing a starter control device which is a second embodiment of the invention. A structure of the starter control device of the embodiment is substantially the same as of the first embodiment. In the figure, like reference numerals are used for designating like or equivalent portions in FIG. 1. FIG. 7(*a*) is a front view showing a control-device contained starter in which the starter control device is incorporated into the starter. FIG. 7(*b*) is a side view of the starter when seen in a direction of X. In the figure, a control-device contained starter 19*a* is generally made up of a mechanism part 35, motor unit 22, main switch 23 and starter control device 1. A bracket 36 forming an outer shell of the mechanism part 35 is formed with a conductive member such as an aluminum die casting member. The motor unit 22, main switch 23 and starter control device 1 are integrally mounted on the bracket 36. A leg part 15*a* of the starter control device 1 is fastened to a mounting seat 37 integral with the bracket 36 by means of a screw 38. The starter 19 is mounted by using a flange 39 integral with the bracket 36, and a minus side of the battery 20 is connected to the engine. Accordingly, the bracket 36 is also connected to the minus side of the battery 20. Thus, the motor unit 22 mounted on the bracket 36, main switch 23 and starter control device 1 are also connected to the minus side of the battery 20.

The battery terminal 30 of the main switch 23 and the B terminal 7 of the starter control device 1 are connected to each other by a lead wire 30*a*. The C terminal 6 of the starter control device 1 and the S terminal 27 of the main switch 23 are also connected to each other by a lead wire 27*a*. The SW terminal 8 of the starter control device 1 is extended by a lead wire 8*a*. This connection is completed at the control-device contained starter 19*a*. This flange 39 is mounted on the engine, and the battery cable 34 is connected to the battery terminal 30, the starter terminal 21*b* of the key switch 21 is connected to the SW terminal 8, and here, predetermined connection work is completed.

The second embodiment is thus structured. Accordingly, the control-device contained starter 19*a* has the following advantages. The wiring is easy. The structure is advantageous for noise reduction approach, and no additional wiring is required, and the size is small, and the mountability is good. The normal starter 19 not having the control circuit part 3 but having the auxiliary switch 2 may easily be altered into a control-device contained starter 19*a* by merely physically incorporating the starter control device 1 instead. In this respect, the standardization of the starter 19 is realized. The starter 19 not having the auxiliary switch 2 may also be altered into a control-device contained starter without additionally applying wiring to the engine side. Further, the starter 19 is formed integrally with the starter control device 1. This results in good mountability. When the control-device contained starter 19*a* is used, a system with the control circuit can be constructed without any additional wiring in a self-completing manner.

As seen from the foregoing description, a starter control device comprises an auxiliary switch for controlling an operation of a starter main switch, the auxiliary switch having a cap made from an insulating member; a control circuit part disposed on the cap; a terminal disposed on the cap; and a connection metal attachment for connecting the control circuit part and the terminal. With such a structure, the present invention succeeds in providing the starter control device improved in that the wire connection is easy, the device size is small, the physical integration of the auxiliary switch with the control circuit part is easy, and the cost to manufacture is low.

Further, in another aspect of the invention, a C terminal in use for controlling an operation of the main switch of the starter, is provided on the cap of the auxiliary switch, and the C terminal and the control circuit part are connected by a fixture. With this additional unique feature, the wire connection is simple, and high performance is ensured, and the cost to manufacture is low.

Also in yet another aspect, a B terminal connected to a battery is provided on the cap of the auxiliary switch, and the B terminal and the control circuit part are connected by a fixture. With this unique feature, the wire connection is simple, and high performance is ensured, and the cost to manufacture is low.

Additionally, in still another aspect, the cap of the auxiliary switch is firmly fixed to a conductive case by means of a conductive screw, the board of the control circuit part, together with the cap, is fastened to the case by means of the screws, and the control circuit part is earthed to the case through the screw. With the feature, the wire connection is simple, and the cost to manufacture is low.

In a further aspect, current is fed from a battery to a coil of the auxiliary switch by way of a starter terminal of a key switch. Therefore, the wire connection is simple, and the cost to manufacture is low.

An additional aspect of the invention is that the control circuit part includes a timer circuit, and the timer circuit prohibits the starter from performing a re-operation for a predetermined period of time, and controls an on time of the power source to the control circuit part. This unique feature provides a starter control device which is easily constructed, has high performances, and consumes less electric power.

The present invention provides a control-device contained starter in which the starter control device is incorporated into a starter. Therefore, a system which is easy in its constructing and has good mountability can be produced in a self-completing manner.

What is claimed is:

1. A starter control device comprising:

an auxiliary switch for controlling an operation of a starter main switch, the auxiliary switch having a cap made from an insulating member which is positioned outside of the starter main switch;

a control circuit part disposed in an opening of the cap;

a terminal disposed on the cap; and a connection metal attachment for electrically connecting the control circuit part and the terminal, the connection metal attachment provided directly on an outer surface of the cap and attached to the terminal at a location outside of the cap and extended inside the cap to be connected to the control circuit part, and wherein resin is provided in the opening of the cap to secure the connection metal attachment and the control circuit part.

2. A starter control device according to claim 1, wherein the terminal comprises a first terminal for controlling an operation of the starter main switch, the first terminal being disposed on the cap, and the first terminal and the control circuit part are connected by the connection metal attachment.

3. A starter control device according to claim 2, wherein a second terminal is provided which is connected to a battery, the second terminal being disposed on the cap, and the second terminal and the control circuit part are connected by the connection metal attachment.

4. A starter control device according to claim 1, wherein the cap is firmly fixed to a conductive case together with a substrate of the control circuit part by a conductive screw, and the control circuit part is grounded to the case through the screw.

5. A starter control device according to claim 1, wherein a current is fed from a battery to a coil of the auxiliary switch by way of a starter terminal of a key switch.

6. A starter control device according to claim 1, wherein the control circuit part includes a timer circuit, and the timer circuit prohibits a starter from performing a re-operation for a predetermined period of time and controls an on time of a power source to the control circuit part.

7. A starter control device according to claim 1, wherein the connection metal attachment includes a tab that extends to the control circuit part.

8. A starter control device according to claim 7, wherein the tab is bent at an angle in regard to a main surface of the connection metal attachment.

9. A starter control device according to claim 1, wherein the resin has an insulating property.

10. A starter control device according to claim 9, further comprising a case which houses the control circuit part together with the cap, wherein the resin is filled into an inside of the case and the opening of the cap to seal the control circuit part.

11. A starter comprising:

a starter main switch; and a starter control device, wherein the starter control device comprises:

an auxiliary switch for controlling an operation of the starter main switch, the auxiliary switch having a cap made from an insulating member which is positioned outside of the starter main switch;

a control circuit part disposed in an opening of the cap;

a terminal disposed on the cap; and a connection metal attachment for electrically connecting the control circuit part and the terminal, the connection metal attachment provided directly on an outer surface of the cap and attached to the terminal at a location outside of the cap and extended inside the cap to be connected to the control circuit part, and wherein resin is provided in the opening of the cap to secure the connection metal attachment and the control circuit part.

12. A starter according to claim 11, wherein the connection metal attachment includes a tab that extends to the control circuit part.

13. A starter according to claim 12, wherein the tab is bent at an angle in regard to a main surface of the connection metal attachment.

14. A starter control device according to claim 11, wherein the resin has an insulating property.

15. A starter control device according to claim 14, further comprising a case which houses the control circuit part together with the cap, wherein the resin is filled into an inside of the case and the opening of the cap to seal the control circuit part.

* * * * *